US010053926B2

(12) United States Patent
Zheng et al.

(10) Patent No.: US 10,053,926 B2
(45) Date of Patent: Aug. 21, 2018

(54) COILED TUBING IN EXTENDED REACH WELLBORES

(71) Applicant: SCHLUMBERGER TECHNOLOGY CORPORATION, Sugar Land, TX (US)

(72) Inventors: Shunfeng Zheng, Katy, TX (US); Nathaniel Wicks, Somerville, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 253 days.

(21) Appl. No.: 14/929,981

(22) Filed: Nov. 2, 2015

(65) Prior Publication Data

US 2017/0122044 A1 May 4, 2017

(51) Int. Cl.
*E21B 17/20* (2006.01)
*E21B 41/00* (2006.01)

(52) U.S. Cl.
CPC ..... *E21B 17/20* (2013.01); *E21B 41/00* (2013.01)

(58) Field of Classification Search
CPC ..... E21B 17/20; E21B 23/14
See application file for complete search history.

(56) References Cited

U.S. PATENT DOCUMENTS 4,116,275 A * 9/1978 Butler ..... E21B 36/00 166/303
6,015,015 A * 1/2000 Luft ..... E21B 17/1007 166/241.6
6,439,318 B1 8/2002 Eddison et al.
6,712,150 B1 3/2004 Misselbrook et al.
7,093,675 B2 * 8/2006 Pia ..... E21B 7/208 175/171
7,139,219 B2 11/2006 Kolle et al.
7,219,726 B2 5/2007 Zheng et al.
2003/0155156 A1 8/2003 Livingstone
2007/0151735 A1 7/2007 Ravensbergen et al.
2010/0276204 A1 11/2010 Connell et al.
(Continued)

FOREIGN PATENT DOCUMENTS

WO WO9701017 A1 1/1997
WO WO9735093 A1 9/1997
(Continued)

OTHER PUBLICATIONS

Search Report and Written Opinion of International Application No. PCT/US2016/057432 dated Jan. 26, 2017, 16 pages.
(Continued)

*Primary Examiner* — D. Andrews
*Assistant Examiner* — Kristyn A Hall

(57) ABSTRACT

A larger diameter coiled tubing is run into an extended reach deviated wellbore to a location at or near its horizontal reach limit. The smaller diameter coiled tubing is then run through the larger diameter tubing until the end of the smaller tubing protrudes from the larger tubing. The smaller tubing is then run further into the wellbore to a location further than would have been possible if either tubing had been run alone. Supplementary reach-increasing techniques such as friction reducing vibrators and/or downhole tractors can also be used in combination with the described techniques.

16 Claims, 6 Drawing Sheets

(56) References Cited

U.S. PATENT DOCUMENTS

2014/0174722 A1* 6/2014 Christie ..... E21B 43/00
166/241.1

FOREIGN PATENT DOCUMENTS

WO WO0120213 A1 3/2001
WO WO0223006 A2 3/2002

OTHER PUBLICATIONS

Newman, K. R., "Vibration and Rotation Considerations in Extending Coiled-Tubing Reach", SPE 106979, Presented at the 2007 SPE/ICoTA Coiled Tubing and Well Intervention Conference and Exhibition, The Woodlands, Texas, pp. 1-9.

* cited by examiner

COILED TUBING IN EXTENDED REACH WELLBORES

FIELD

The subject disclosure generally relates to the field of coiled tubing in wellbores. More particularly, the subject disclosure relates to techniques for deploying coiled tubing in extended reach wellbores.

BACKGROUND

Coiled tubing has been used in many extended reach wells. Due to its inherent characteristics, coiled tubing has rather limited extended reach capability. Many wells that can be successfully drilled by the drillers cannot be properly serviced by conventional coiled tubing deployment techniques. As a result, many technologies have been actively pursued to extend the reach of coiled tubing.

The technologies that have been considered for extending the reach of coiled tubing fall into two different categories: reducing friction or generating pull force downhole. Technologies that aim to reduce friction in order to increase coiled tubing reach include using friction reducing agents and downhole vibration technologies. Technologies for using downhole pull force to increase extended reach are typically based on downhole tractor technology. The downhole tractors available today are either electrically or hydraulically powered. For electrically powered downhole tractors, the pull force generated by available tractors is typically in the order of 1000 lbs. For hydraulically powered downhole tractors, the pull force generated by available downhole tractors is between 4000-8000 lbs. Downhole tractor solutions for coiled tubing deployment tend to be relatively complex and expensive.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to some embodiments, a method of deploying coiled tubing into an extended reach wellbore is described. The method includes: positioning a first coiled tubing into the wellbore such that the bottom end of the first coiled tubing resides in a deviated portion of the wellbore; translating a second coiled tubing having an outer diameter less than the inner diameter of the first coiled tubing through the first coiled tubing, such that the bottom end of the second coiled tubing extends past the bottom end of the first coiled tubing. The second coiled tubing is further translated through the first coiled tubing and into the deviated portion of the wellbore, such that the second coiled tubing is deployed further into the deviated portion of the wellbore than either the first or second coiled tubing could have been deployed independently.

According to some embodiments, the deviated portion of the well may deviate by more than 80 degrees from vertical and in some cases is horizontal or nearly horizontal. In some embodiments, the first coiled tubing is positioned in the deviated portion of the wellbore while the second coiled tubing is not within the first coiled tubing. In some cases, bottom hole assembly (BHA) is mounted to the bottom end of the first coiled tubing prior to being deployed in the wellbore. The first coiled tubing is run into the wellbore with the bottom hole assembly mounted on it. When the bottom end of the second coiled tubing reaches the BHA on the end of the first coiled tubing, the BHA is re-mounted on the bottom end of the second coiled tubing. The translation and deployment of the second coiled tubing is then carried out with the BHA mounted on its bottom end. According to some embodiments, the BHA includes one or more of the following: a vibrator, tractor, nozzle, drilling assembly, measurement device and packer. In cases where the BHA includes a vibrator, the second coiled tubing can be vibrated during deployment to further increase its horizontal reach. Similarly, in cases where the BHA includes a tractor, the second coiled tubing can be pulled, at least in part, during deployment to further increase its horizontal reach.

According to some embodiments, the bottom end of the first coiled tubing includes one or more dynamic sealing elements, such as provided in a downhole stripper. The annular region between the first coiled tubing and the second coiled tubing can be pressurized during the deployment of the second coiled tubing. Pressurization of the annular region inhibits bending and buckling of the second coiled tubing string within the first coiled tubing.

According to some embodiments, the first coiled tubing is positioned in the deviated portion of the wellbore while the second coiled tubing is already located within the first coiled tubing. Both the first and second tubing are run into the wellbore together to a given depth. Thereafter the second tubing is translated further into the wellbore.

According to some embodiments, different fluids are pumped from the surface into (1) the inside of the second coiled tubing; (2) the annulus between the first tubing and second tubing; and/or (3) an annular region outside the first coiled tubing (e.g. between the first coiled tubing and the borehole wall). The different fluids can be used to create an optimal downhole mixture of the fluids for treating the wellbore.

According to some embodiments, the first coiled tubing is rotating from the surface and/or vibrated from the surface to reduce friction between the first coiled tubing and the second coiled tubing. The vibrating can be axial and/or torsional in nature.

As used herein the term "coiled tubing" refers to a type of tubing that is typically supplied spooled on a large reel on the surface. The term "coiled tubing" does not mean that the tubing is in a coiled form when deployed in a wellbore.

Further features and advantages of the subject disclosure will become more readily apparent from the following detailed description when taken in conjunction with the accompanying drawings.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

Figure 1:
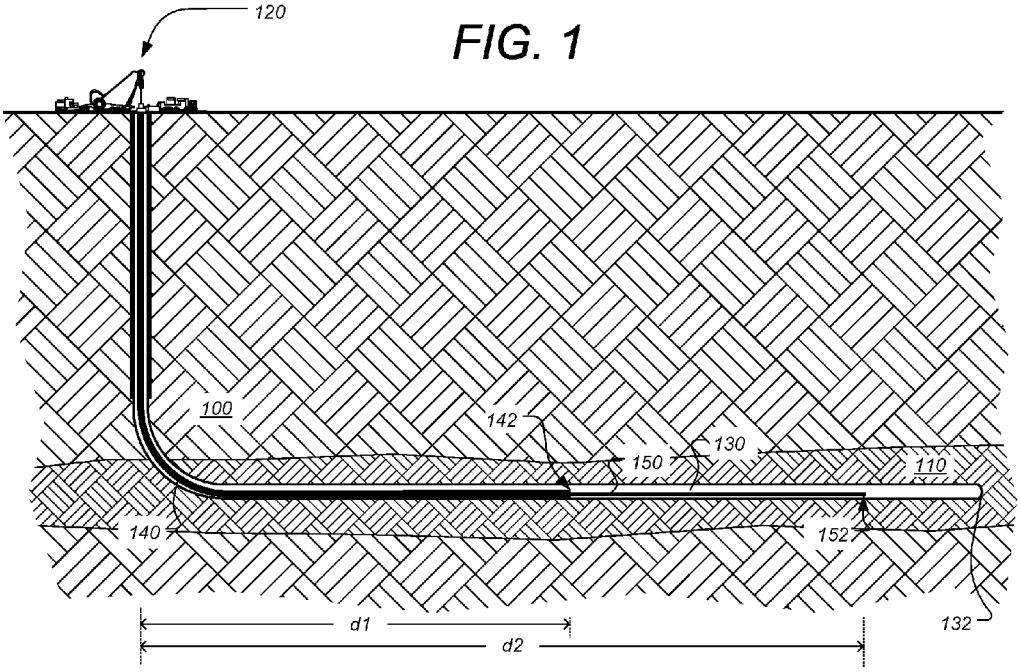
FIG. 1 is a diagram illustrating an extended reach well in which a coiled tubing system is being deployed, according to some embodiments.

The particulars shown herein are by way of example and for purposes of illustrative discussion of the examples of the subject disclosure only, and are presented in the cause of providing what is believed to be the most useful and readily understood description of the principles and conceptual aspects of the subject disclosure. In this regard, no attempt is made to show structural details in more detail than is necessary, the description taken with the drawings making apparent to those skilled in the art how the several forms of the subject disclosure may be embodied in practice. Furthermore, like reference numbers and designations in the various drawings indicate like elements. As used herein, the terms and phrases "deviated section or portion of the well", "deviated section or portion", "horizontal section or portion of the well", and "horizontal section or portion" are used interchangeably to indicate the section of the well that departs from the vertical wellbore.

According to some embodiments, techniques are described to extend the reach of coiled tubing. An example workflow is described as follows:

1. Plan the coiled tubing job to identify the depth where a treatment coiled tubing will likely experience helical buckling or lockup.
2. Equip a larger diameter coiled tubing string with a downhole stripper at its bottom end. The inner diameter of this coiled tubing should be larger than the outer diameter of the treatment coiled tubing.
3. Run the larger diameter coiled tubing to a depth beyond which helical buckling was predicted to have occurred for the treating coiled tubing.
4. Run the treatment coiled tubing through the inside of the larger diameter coiled tubing, and through the downhole stripper of the larger OD coiled tubing.

Note that at the wellhead, a stripper or seal is provided between the upper end of the larger coiled tubing and the smaller coiled tubing. The annulus between the larger coiled tubing and the smaller coiled tubing is accessible at surface to receive wellbore fluid, or to inject treatment fluid. Due to smaller annular space between the smaller diameter and larger diameter tubing, helical bending and buckling is inhibited and the small diameter tubing can be deployed to locations that would not have been possible with either the coiled tubing sizes run separately. According to some embodiments, the fluid pressure between the annulus of the treatment coiled tubing and the larger diameter coiled tubing is increased which further inhibits helical bending and buckling of treatment coiled tubing within the larger diameter coiled tubing When the bottom end of the treatment coiled tubing has passed through the stripper at the bottom of the larger tubing, increasing the annulus pressure between the two tubing's increases the apparent bending stiffness of the portion of the treatment coiled tubing that is inside the larger tubing. The increase is conveniently equivalent to a downhole pull force. As an example, for a 2" OD treatment coiled tubing, a moderate downhole pressurization of 2000 psi is equivalent to over 6000 lbs downhole pulling force on the coiled tubing. According to some embodiments, techniques that are both simpler and cheaper than downhole tractors are provided. The configuration of a smaller diameter coiled tubing inside a larger diameter coiled tubing allows the execution of many other operations that are beneficial but not available to the oilfield services today.

FIG. 1 is a diagram illustrating an extended reach well in which a coiled tubing system is being deployed, according to some embodiments. An extended reach wellbore 130 is shown through earth 100 and into target rock formation 110. Notably, the wellbore 130 includes a substantial length of horizontal or nearly horizontal orientation between the vertical section and the wellbore end 132. According to some embodiments, the wellbore 130 is dimensioned as follows. From the vertical section kickoff it is about 5000 feet measured depth (MD) and the transition from vertical to horizontal is between 5000 feet MD and 6000 feet MD. The total horizontal reach of the well is about 14,500 feet, and the total MD is about 20,000 feet. In this example, the vertical section is completed in a production tubing of 4.5" and the horizontal section is completed in a 5.5" casing. Using conventional coiled tubing techniques, it would be difficult or impossible to perform a treatment at or near the far end of the wellbore. Even using expensive tractor devices, deployment of coiled tubing would be challenging.

According to some embodiments, a larger diameter coiled tubing 140 (e.g. 2⅞" tubing) is run into the horizontal section so that its bottom end 142 lies at a horizontal reach of d1. Then a narrower tubing 150 (e.g. 2" tubing) is run through the larger tubing 140, out into the horizontal section of wellbore 130 so that its bottom end 152 lies at a horizontal reach of d2. During deployment, the annulus between the larger diameter and narrower tubing is pressurized to further inhibit helical bending and buckling. According to some embodiments, d1 is about 8,500 feet and d2 is about 13,600 feet. Notably, the horizontal reach of each tubing alone would have been much less than d2.

Figure 2A:
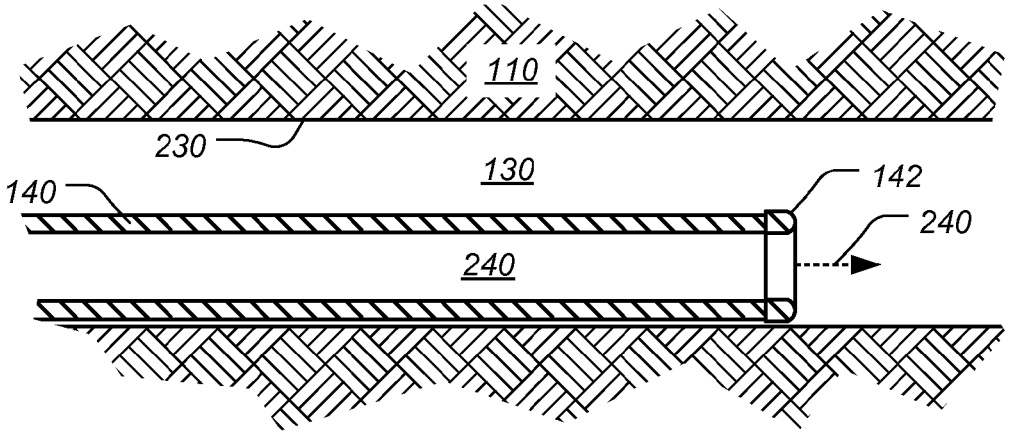
FIGS. 2A-2D are cross sectional schematic diagrams illustrating further details of certain aspects of a coiled tubing system being deployed in an extended reach wellbore, according to some embodiments.
Figure 2B:
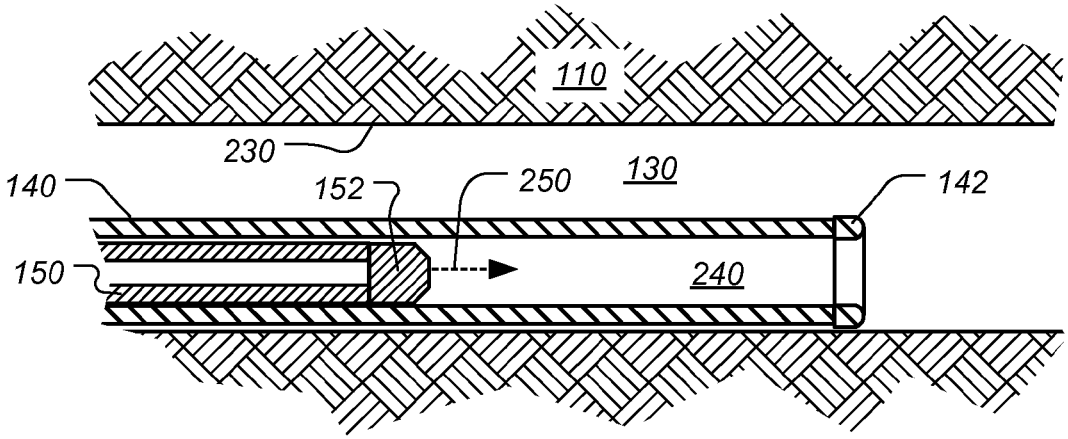
Figure 2C:
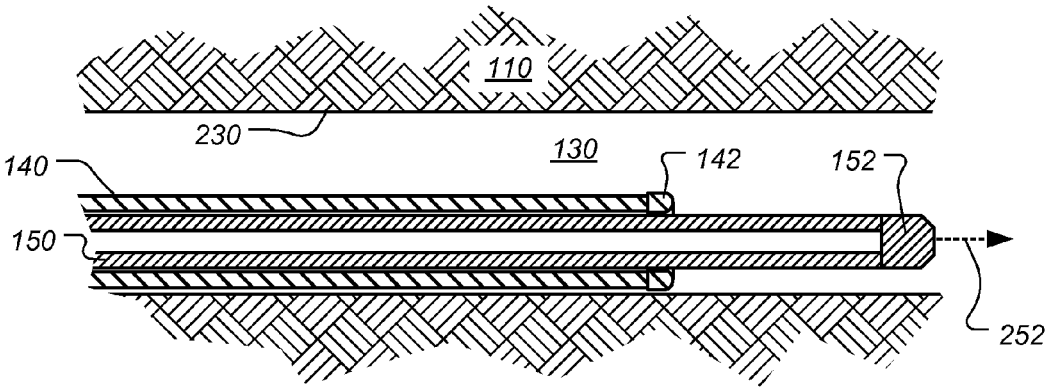

FIGS. 2A-2D are cross sectional schematic diagrams illustrating further details of certain aspects of a coiled tubing system being deployed in an extended reach wellbore, according to some embodiments. In FIG. 2A a larger diameter coiled tubing string 140 is being run into extended reach wellbore 130 within target rock formation 110 as shown by dotted arrow 240. The bottom end 142 of larger diameter coiled tubing string 140 may be run to a depth beyond which helical buckling occurs for the treating coiled tubing (as shown in FIG. 1, supra.). In FIG. 2B, the narrower coiled tubing 150, which will be used in the treatment, is run within the larger tubing 140 as shown by dotted arrow 250. Note that the tubing's are dimensioned such that the outer diameter of the narrower tubing 150 is less than the inner diameter of the larger tubing 140. In FIG. 2C, the bottom end 152 of narrower tubing 150 is run past the bottom end 142 of larger tubing 140. The narrower tubing 150 is further run, as shown by dotted arrow 252 into the wellbore 130 well beyond the bottom end 142 of tubing 140. Due to smaller annular space between tubing 150 and tubing 140, helical bending and buckling is inhibited in tubing 150 such that it can be deployed to locations within wellbore 130 that would not have been possible with either the coiled tubing 140 or 150 run alone.

The described coiled tubing system can be used to greatly increase the horizontal reach of coiled tubing. The improved reach system can be used for various types of coiled tubing jobs such as well treatments (e.g. sand cleanout, fluid diversion, acidizing, etc).

Figure 2D:
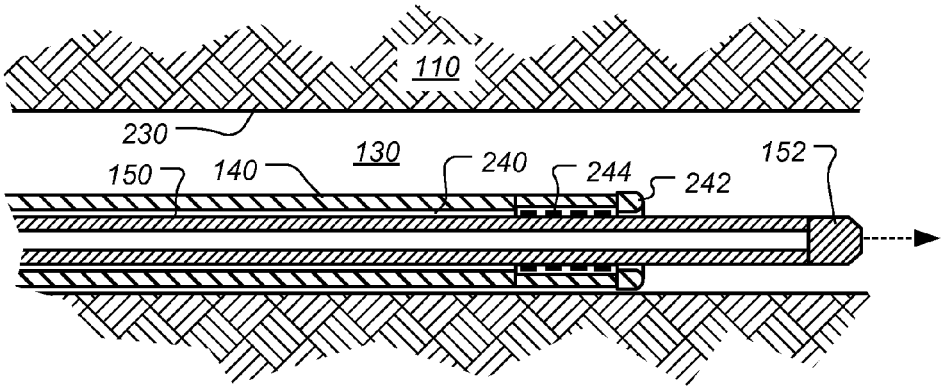

FIG. 2D shows an alternative wherein the bottom end 242 of the larger tubing 140 is fitted with a downhole stripper 244. By providing a stripper or other dynamic pressure sealing technique, the annulus 240 between the tubing 150 and tubing 140 may be pressurized when the narrower tubing 150 is being run past the bottom end of tubing 140. By increasing the pressure in the annulus 240, bending and buckling of tubing 150 within tubing 140 can be inhibited so as to allow for increased horizontal deployment reach by tubing 150. In some embodiments, a tubing anchor (not shown) may be installed at the bottom end 242 of the larger coiled tubing 140 to attach itself to the wellbore 130. Once installed, the larger tubing 140 will be able to anchor to the wellhead at the surface. According to some other embodiments, the larger tubing 140 is attached to a rotational device at the surface, which may in turn rotate the larger tubing 140 during the running of the narrower tubing 150 to further reduce friction. According to some embodiments, the annulus between the larger tubing 140 and the smaller tubing 150 may be used to pump fluid to assist wellbore treatment.

According to some embodiments, the bottom end 152 of the narrower coiled tubing 150 is a small-diameter BHA that could include a small-diameter vibrator and/or tractor device. In such cases, the small-diameter vibrator and/or tractor device helps to translate coiled tubing 150, both when it is totally inside the larger tubing 140 as well as after it has passed through the bottom end 142 of tubing string 140.

Figure 3A:
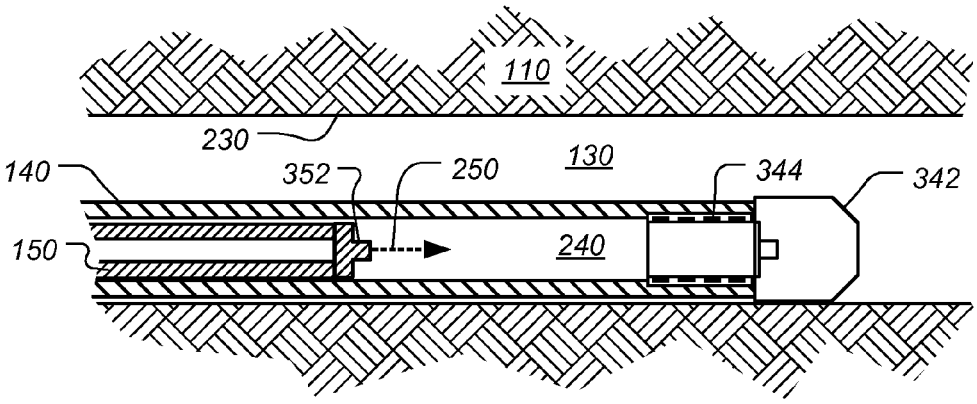
FIGS. 3A and 3B are cross sectional schematic diagrams illustrating further details of certain aspects of a coiled tubing system being deployed in an extended reach wellbore, according to some embodiments.
Figure 3B:
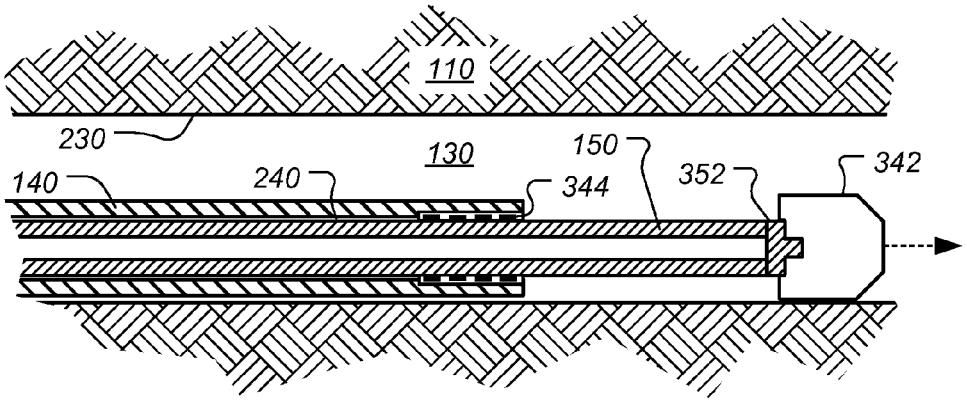

FIGS. 3A and 3B are cross sectional schematic diagrams illustrating further details of certain aspects of a coiled tubing system being deployed in an extended reach wellbore, according to some embodiments. In FIG. 3A, the larger diameter coiled tubing 140 is first run into wellbore 130 as described with respect to FIGS. 1 and 2A, supra. In this case, however, tubing 140 has a bottom hole assembly (BHA) 342 at its bottom end. This BHA 342 may include various coiled tubing operational components (e.g. nozzles, packers, etc), as well as devices for extending reach (vibrators, tractors, etc). After running the tubing string 140 into the well 130 (including using reach extension devices in the BHA 342 if desired), the narrower tubing string 150 is run inside the larger tubing string 140 as shown with dotted arrow 250 in FIG. 3A. Once the bottom end 352 of smaller tubing string 150 arrives at the BHA 342, the BHA 342 can, through mechanical (or other) means, be disconnected from the larger tubing string 140 and connected to the end 352 of smaller tubing string 150 as shown in FIG. 3B. The smaller tubing string 150 then continues to run into the well 130, with the BHA 342 now attached to its downhole end 352. This enables the use of a fairly large outer diameter BHA on the end of the small outer diameter tubing string. Note that the BHA 342 may not fit through the inner diameter of the larger tubing string 140.

According to some embodiments, a downhole stripper 344 or other technique can be used to form a dynamic seal around the bottom end of tubing 140 such that the annulus 240 can be pressurized. According to some embodiments, the reach of the narrow tubing 150 is extended by increasing the pressure within the annulus 240 between the two tubing's 140 and 150, by vibrating the larger coiled tubing 140, or by rotating the larger coiled tubing 140. The larger coiled tubing 140 may be rotated or vibrated from the surface to reduce the friction between the narrower coiled tubing 150 and the larger coiled tubing 140. Alternatively or additionally, the pressure may be increased in annulus 240 to have a positive effect of stiffening the treating coiled tubing 150 for extended reach. For example, in the case of a 2" narrow coiled tubing 150, increasing the pressure in annulus 240 by 2000 psi is equivalent to an additional pull force of over 6000 lbs. According to some embodiments, the downhole stripper 344 can be equipped with various control valves to take in fluid from the wellbore 130, or to deliver fluid from the surface into the wellbore, thus enabling many well service operations, such as sand clean out, acidizing, etc.

According to some embodiments, the coiled tubing system can be used in conjunction with other technologies to increase the extended reach of the narrow coiled tubing 150. For example, in some embodiments the BHA 342 includes a tractor device that is first used to pull the larger tubing 140 and then is later used for pulling the narrower coiled tubing 150 within wellbore 130. In some other embodiments, the BHA 342 includes a downhole vibration device that is first used to vibrate larger tubing 140 during deployment and later used to vibrate tubing 150 during its deployment.

According to yet further embodiments, the larger coiled tubing 140 can be modified such that its inner surface exhibits anisotropic friction properties. For example, the coefficient of friction in the circumferential direction is made to be much higher than in the axial direction. As a result, the helical buckling tendency of the treating coiled tubing inside the larger coiled tubing 140 is further reduced, thereby further extending the horizontal reach of the system.

Figure 4A:
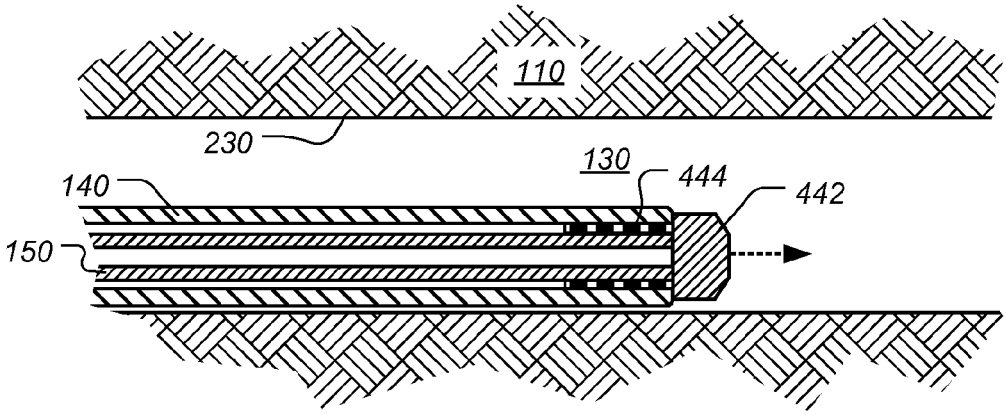
FIGS. 4A-4B are diagrams illustrating techniques for coiled tubing deployment in extended reach wells, according to some other embodiments.
Figure 4B:
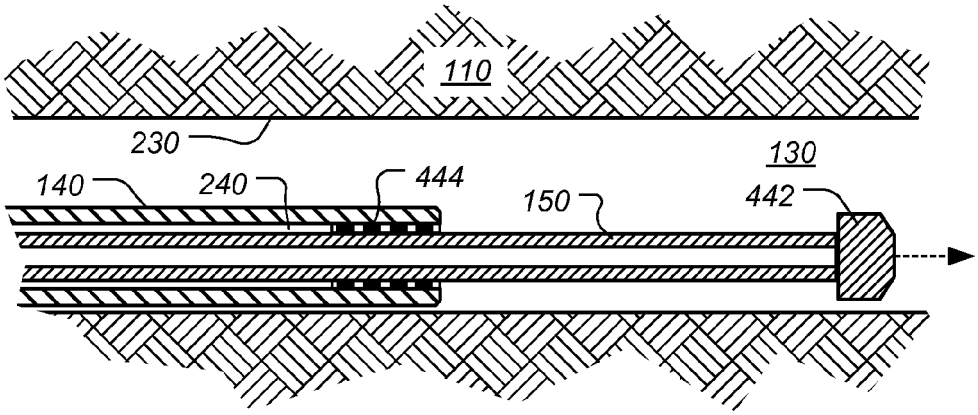

FIGS. 4A-4B are diagrams illustrating techniques for coiled tubing deployment in extended reach wells, according to some other embodiments. In this case, larger tubing 140 and the narrower tubing 150 are first deployed together, such as shown in FIG. 4A. When the combined tubing structure is deployed to a suitable horizontal reach location, the narrow tubing 150 is further extended into wellbore 130 as shown in FIG. 4B. According to some embodiments, a downhole stripper 444 or other technique is used to form a dynamic seal around the bottom end of tubing 140 such that the annulus 240 can be pressurized. According to some embodiments, BHA 442 can include a vibrational device and/or tractor device, such as described with respect to BHA 342 in FIGS. 3A and 3B, supra.

Figure 5A:
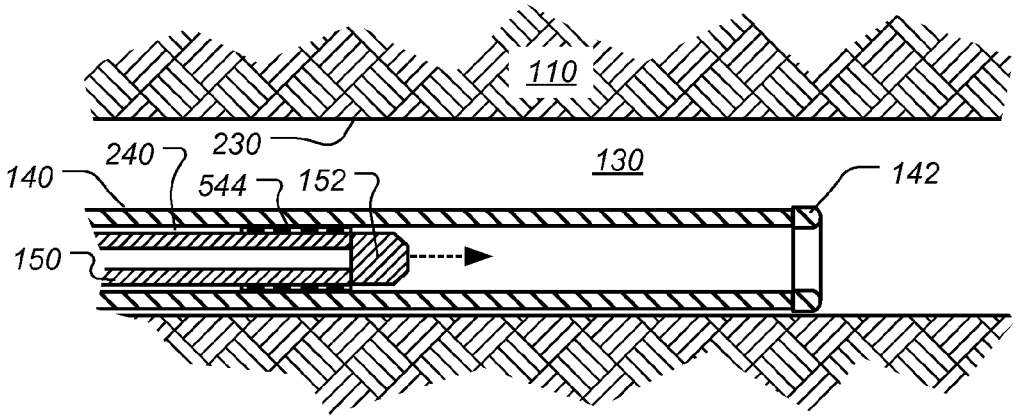
FIGS. 5A-5B are diagrams illustrating further details of techniques for coiled tubing deployment in extended reach wells, according to some other embodiments.
Figure 5B:
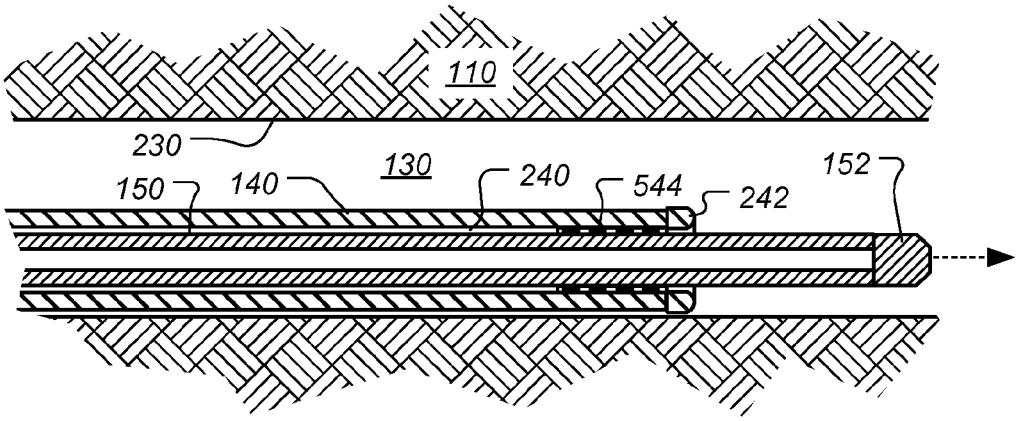

FIGS. 5A-5B are diagrams illustrating further details of techniques for coiled tubing deployment in extended reach wells, according to some other embodiments. The case shown is similar to that of FIG. 2D, supra, except that the stripper is initially deployed with narrower tubing 150 instead of larger tubing 140. In FIG. 5A, the stripper 544, or other dynamic sealing device, is attached to the narrower tubing 150 at its bottom end 152. The stripper/seal 544 moves along with the downhole end 152 of tubing 150, constantly sealing the annular region 240 between the two tubes 150 and 140. According to some embodiments, the configuration shown in FIG. 5A can also be used to pump the narrower tubing 150 through the tubing 140 until the end 152 reaches the end 142. Once the stripper/seal 544 reaches the bottom end 142, the stripper/seal 544 remains with bottom end 142 as shown in FIG. 5B. Note that the stripper/seal 544 forms a dynamic seal on its outer surface before the "hand-off" (i.e. before the point at which the bottom end 152 passes the bottom end 142), and it forms a dynamic seal on its inner surface after the "hand-off." According to some embodiments, the stripper/seal hand-off configuration shown in FIGS. 5A-5B is combined with the BHA hand-off configuration shown in FIGS. 3A-3B such that the stripper/seal is first deployed with the narrower tubing instead of being initially attached to the larger tubing 150 (as shown in FIG. 3A.). The stripper/seal is then "handed off" to the larger tubing end 142 when it reaches that location.

According to some embodiments, a third, even narrower coiled tubing is run within the narrow tubing to reach even further into the wellbore.

Although only a few examples have been described in detail above, those skilled in the art will readily appreciate that many modifications are possible in the examples without materially departing from this subject disclosure. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method of deploying coiled tubing into an extended reach wellbore comprising:

positioning a first coiled tubing having an inner diameter into the wellbore such that a bottom end of the first coiled tubing resides in a deviated portion of the wellbore;

translating a second coiled tubing having an outer diameter less than the inner diameter of the first coiled tubing through the first coiled tubing such that a bottom end of the second coiled tubing extends past the bottom end of the first coiled tubing;

continuing to translate the second coiled tubing through the first coiled tubing and into the deviated portion of the wellbore so that the second coiled tubing is deployed further into the deviated portion of the wellbore than either the first or second coiled tubing could be deployed independently; and dynamically sealing an annular region between the first coiled tubing and the second coiled tubing during said translating; and pressurizing the annular region by at least 2000 psi during the translating, thereby inhibiting bending and buckling of the second coiled tubing within the first coiled tubing during said translating.

2. The method of claim 1 wherein the first coiled tubing is positioned in the deviated portion of the wellbore while the second coiled tubing is not within the first coiled tubing.

3. The method of claim 2 further comprising:

mounting a bottom hole assembly to the bottom end of the first coiled tubing prior to the positioning such that the bottom hole assembly is deployed on the bottom end of the first coiled tubing in the deviated portion of the wellbore; and re-mounting at least a portion of the bottom hole assembly to the bottom end of the second coiled tubing while in the deviated portion of the wellbore such that at least a portion of bottom hole assembly is deployed on the bottom end of the second coiled tubing during the continuing of the translation of the second coiled tubing through the first coiled tubing.

4. The method of claim 3 wherein the at least a portion of the bottom hole assembly that is re-mounted to the bottom end of the second coiled tubing includes equipment of a type selected from a group consisting of: vibrator, tractor, nozzle, drilling assembly, measurement device and packer.

5. The method according to claim 4 wherein the at least a portion of the bottom hole assembly includes a vibrator and the method further comprises:

vibrating the second coiled tubing during at least a portion of the translating with the vibrator while re-mounted to the bottom end of the second coiled tubing.

6. The method according to claim 4 wherein the at least a portion of the bottom hole assembly includes a tractor and wherein the translating of the second coiled tubing through the first coiled tubing is at least partially aided by a pulling force from the tractor while re-mounted to the bottom end of the second coiled tubing.

7. The method of claim 1 wherein the first coiled tubing is positioned in the deviated portion of the wellbore while the second coiled tubing is already located within the first coiled tubing.

8. The method of claim 1 wherein the dynamically sealing is partially carried out using a dynamic seal located on an outer surface of the second coiled tubing near its bottom end before the bottom end of the second coiled tubing reaches the bottom end of the first coiled tubing.

9. The method of claim 1 wherein the dynamically sealing is partially carried out using a dynamic seal located on an inner surface of the first coiled tubing near its bottom end after the bottom end of second coiled tubing has passed the bottom end of the first coiled tubing.

10. The method according to claim 1 wherein translating of the second coiled tubing is aided by a vibrator and/or tractor located on the bottom end of the second coiled tubing both before and after when the bottom end of the second coiled tubing passes the bottom end of the first coiled tubing.

11. The method according to claim 1 further comprising:

anchoring the first coiled tubing at a wellhead of the wellbore; and flowing a first fluid into an annular region between the first tubing and second tubing from either the wellhead or from the wellbore.

12. The method according to claim 1 further comprising:

pumping a first fluid into the second coiled tubing;

pumping a second fluid into an annular region between the first and second tubing; and treating the wellbore with a predetermined mixture of the first and second fluids.

13. The method of claim 12 further comprising pumping a third fluid into an annulus outside of the first tubing, and wherein the treating is with a predetermined mixture of the first, second and third fluids.

14. The method of claim 1 further comprising:

rotating the first coiled tubing from the surface to reduce friction between the first tubing and second coiled tubing.

15. The method of claim 1 further comprising vibrating the first coiled tubing to reduce friction between the first tubing and second coiled tubing.

16. The method of claim 15 wherein the vibrating is axial and/or torsional.

* * * * *